US009745864B2

(12) United States Patent
Willett et al.

(10) Patent No.: US 9,745,864 B2
(45) Date of Patent: Aug. 29, 2017

(54) SYSTEMS AND METHODS FOR ANTI-ROTATIONAL FEATURES

(71) Applicant: United Technologies Corporation, Hartford, CT (US)

(72) Inventors: Matthew R. Willett, Portsmouth, NH (US); Charles H. Warner, South Portland, ME (US); Gerald D. Cassella, North Berwick, ME (US); Jonathan J. Earl, Wells, ME (US); Christopher B. Lyons, West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 284 days.

(21) Appl. No.: 14/665,780

(22) Filed: Mar. 23, 2015

(65) Prior Publication Data

US 2015/0300205 A1 Oct. 22, 2015

Related U.S. Application Data

(60) Provisional application No. 61/980,169, filed on Apr. 16, 2014.

(51) Int. Cl.
*F01D 9/04* (2006.01)
*F01D 25/24* (2006.01)

(52) U.S. Cl.
CPC ..... *F01D 25/246* (2013.01); *F01D 9/041* (2013.01); *F05D 2220/32* (2013.01);
(Continued)

(58) Field of Classification Search
CPC .... F01D 9/041; F01D 25/246; F05D 2220/32; F05D 2230/10; F05D 2230/30;
(Continued)

(56) References Cited

U.S. PATENT DOCUMENTS 2,654,566 A * 10/1953 Boyd ..... F01D 9/042 415/137
3,529,904 A * 9/1970 Borden ..... F01D 11/001 277/419

(Continued)

FOREIGN PATENT DOCUMENTS

DE 102009003638 10/2009
EP 1308630 5/2003

OTHER PUBLICATIONS

Extended European Search Report dated Sep. 14, 2015 in European Application No. 15163772.5.

*Primary Examiner* — Igor Kershteyn
(74) *Attorney, Agent, or Firm* — Snell & Wilmer, L.L.P.

(57) ABSTRACT

Systems and methods are disclosed for anti-rotation lugs. A stator for a gas turbine engine may comprise an outer shroud, an inner shroud, and a plurality of vanes located between the outer shroud and the inner shroud. A plurality of anti-rotation lugs may be coupled to the inner shroud. The anti-rotation lugs may be configured to contact a diffuser case in order to prevent rotation of the stator. The anti-rotation lugs may comprise a body and a tapered shoulder. The tapered shoulder may distribute stress concentrations in the anti-rotation lugs.

16 Claims, 4 Drawing Sheets

(52) U.S. Cl.
CPC ..... *F05D 2230/10* (2013.01); *F05D 2230/30* (2013.01); *F05D 2230/60* (2013.01); *F05D 2240/12* (2013.01); *F05D 2240/14* (2013.01); *F05D 2240/80* (2013.01)

(58) Field of Classification Search
CPC ..... F05D 2230/60; F05D 2240/80; F05D 2240/12; F05D 2240/14
See application file for complete search history.

(56) References Cited

U.S. PATENT DOCUMENTS

| | | | | | |
|---|---|---|---|---|---|
| 4,011,718 | A * | 3/1977 | Asplund | F01D 9/042 | 415/189 |
| 4,621,976 | A * | 11/1986 | Marshall | F01D 5/24 | 415/119 |
| 4,820,119 | A * | 4/1989 | Joyce | F01D 11/02 | 277/415 |
| 4,856,963 | A * | 8/1989 | Klapproth | F01D 9/042 | 415/189 |
| 6,183,192 | B1 * | 2/2001 | Tressler | F01D 5/189 | 415/115 |
| 6,932,568 | B2 * | 8/2005 | Powis | F01D 5/189 | 415/189 |
| 2004/0120810 | A1 * | 6/2004 | Brainch | F01D 5/145 | 415/191 |
| 2009/0246012 | A1 * | 10/2009 | Shapiro | F01D 9/042 | 415/208.1 |
| 2011/0243725 | A1 | 10/2011 | Jones et al. | | |

* cited by examiner

SYSTEMS AND METHODS FOR ANTI-ROTATIONAL FEATURES

CROSS-REFERENCE TO RELATED APPLICATIONS

This application is a nonprovisional of, and claims priority to, and the benefit of U.S. Provisional Application No. 61/980,169, entitled "SYSTEMS AND METHODS FOR ANTI-ROTATIONAL FEATURES," filed on Apr. 16, 2014, which is hereby incorporated by reference in its entirety.

FIELD

The present disclosure relates generally to gas turbine engines. More particularly, the present disclosure relates to systems and methods for anti-rotation features in components in gas turbine engines.

BACKGROUND

Gas turbine engines typically comprise alternating rows of rotors and stators. Air flowing through the gas turbine engine may contact stationary stator vanes. The airflow may apply a circumferential torque on the stator vanes. The stators may comprise anti-rotation features in order to prevent the stators from rotating. The anti-rotation features may add weight and package size to the stators.

SUMMARY

An anti-rotation lug may comprise a body having a contact face. The anti-rotation lug may also comprise a tapered shoulder. The anti-rotation lug may further comprise a leading fillet located between the contact face and the tapered shoulder.

In various embodiments, the body of the anti-rotation lug may be attached to a stator and the contact face may be configured to contact a diffuser case to prevent the stator from rotating. The anti-rotation lug may comprise a shoulder fillet located between the shoulder and an inner ring of a stator. The anti-rotation lug may comprise a trailing fillet located between a trailing side of the anti-rotation lug and an inner ring of a stator. The tapered shoulder may be oriented transverse to an engine axis at an angle of between 60°-80°. The leading fillet may comprise a radius of at least 0.050 inches, and the shoulder fillet may comprise a radius of at least 0.200 inches.

A stator may comprise an outer shroud, at least one vane coupled to the outer shroud, an inner shroud coupled to the at least one vane, and an anti-rotation lug coupled to the inner shroud. The anti-rotation lug may comprise a body and a tapered shoulder.

In various embodiments, the inner shroud may comprise an outer ring and an inner ring. The anti-rotation lug may be coupled to the inner ring. The inner ring may extend axially from the outer ring along an engine axis. The anti-rotation lug may comprise a leading fillet located between the body and the tapered shoulder. The stator may comprise a shoulder fillet located between the tapered shoulder and the inner shroud. The leading fillet may comprise a radius of about 0.062 inches. The anti-rotation lug may be configured to contact a diffuser case to prevent the stator from rotating.

An assembly for a gas turbine engine may comprise a stator and a diffuser case. The stator may have an anti-rotation lug. The anti-rotation lug may include a tapered shoulder. The diffuser case may be configured to contact the anti-rotation lug.

In various embodiments, the anti-rotation lug may be coupled to an inner ring of the stator. The stator may comprise an inner shroud, and the inner shroud may comprise a stepped profile. The stator may comprise twenty-four anti-rotation lugs. The stator may comprise a single component manufactured by at least one of casting, machining, additive manufacture, or assembly of component parts metallurgically bonded, such as by welding or brazing.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for exemplary purposes and not for limiting any embodiments disclosed herein. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment options. Additionally, any reference to "without contact" (or similar phrases) may also include reduced contact or minimal contact.

Figure 1:
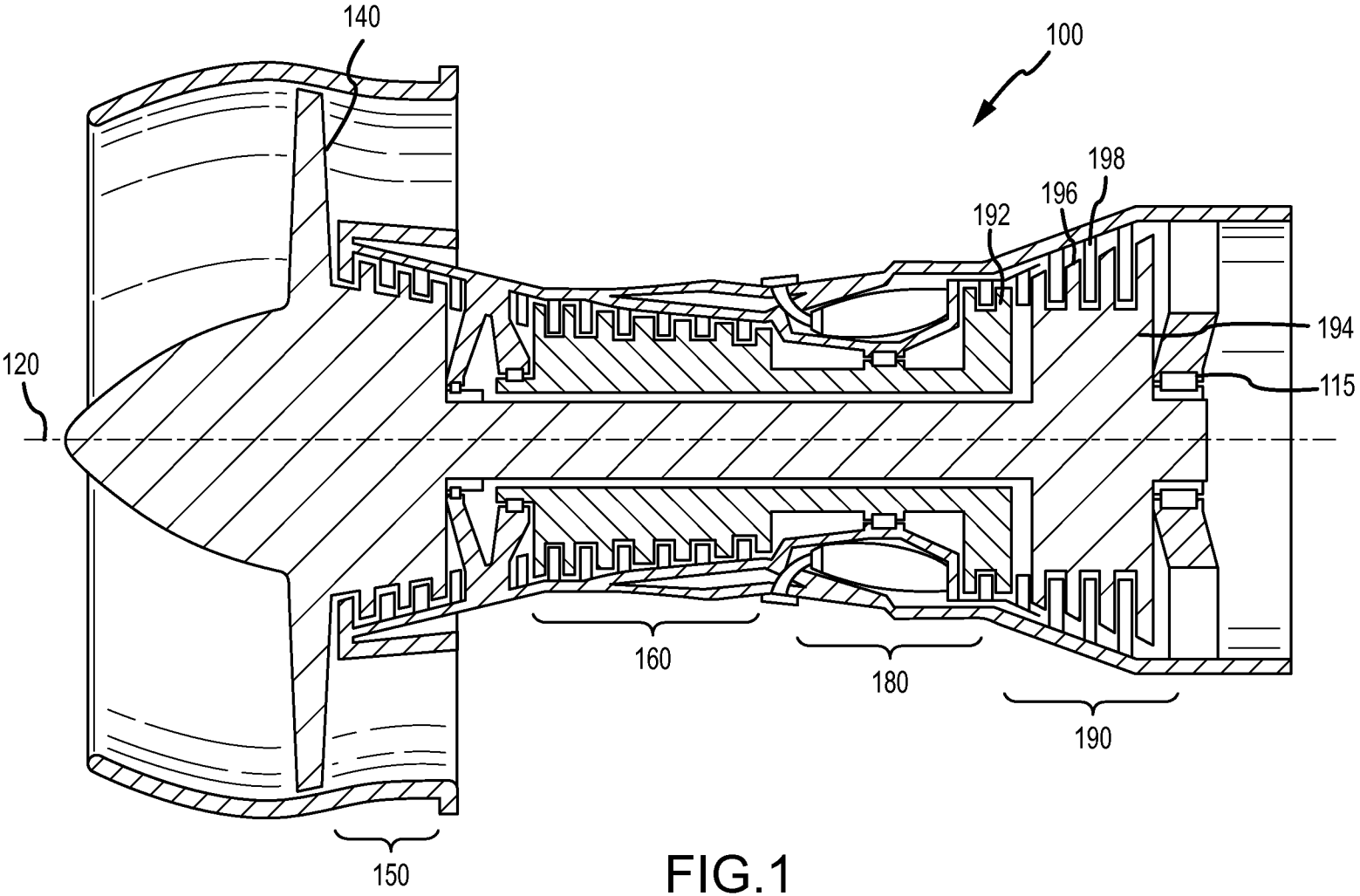
FIG. 1 illustrates a schematic cross-section view of a gas turbine engine in accordance with various embodiments.

Referring to FIG. 1, a gas turbine engine 100 (such as a turbofan gas turbine engine) is illustrated, according to various embodiments. Gas turbine engine 100 is disposed about axial centerline axis 120, which may also be referred to as axis of rotation 120. Gas turbine engine 100 may comprise a fan 140, compressor sections 150 and 160, a combustion section 180, and a turbine section 190. Air compressed in the compressor sections 150, 160 may be mixed with fuel and burned in combustion section 180 and expanded across turbine section 190. Turbine section 190 may include high pressure rotors 192 and low pressure rotors 194, which rotate in response to the expansion. Compressor sections 150, 160 and turbine section 190 may comprise alternating rows of rotary airfoils or blades 196 and static airfoils or vanes 198. A plurality of bearings 115 may support spools in the gas turbine engine 100.

FIG. 1 provides a general understanding of the sections in a gas turbine engine, and is not intended to limit the disclosure. The present disclosure may extend to all types of turbine engines, including turbofan gas turbine engines and turbojet engines, for all types of applications.

The forward-aft positions of gas turbine engine 100 lie along axis of rotation 120. For example, fan 140 may be referred to as forward of turbine section 190 and turbine section 190 may be referred to as aft of fan 140. Typically, during operation of gas turbine engine 100, air flows from forward to aft, for example, from fan 140 to turbine section 190. As air flows from fan 140 to the more aft components of gas turbine engine 100, axis of rotation 120 may also generally define the direction of the air stream flow.

Figure 2:
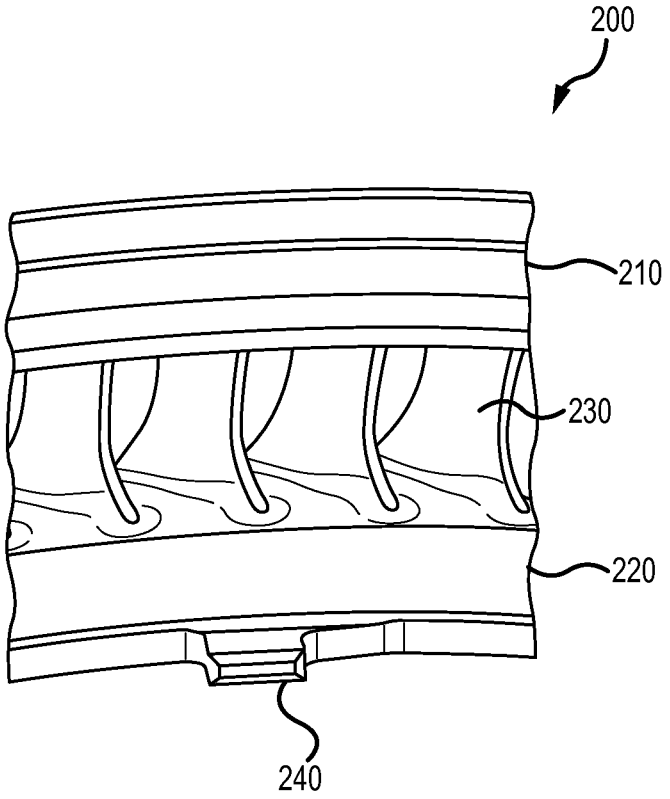
FIG. 2 illustrates a perspective view of a stator in accordance with various embodiments.

Referring to FIG. 2, an aft view of a portion of a stator 200 is illustrated, according to various embodiments. In various embodiments, stator 200 may comprise an exit guide vane for a high pressure compressor. However, in various embodiments, stator 200 may comprise any stator within gas turbine engine 100. In various embodiments, stator 200 may comprise a full ring stator.

Stator 200 may comprise an outer shroud 210 and an inner shroud 220 radially spaced apart from each other. In various embodiments, outer shroud 210 may form a portion of an outer core engine structure, and inner shroud 220 may form a portion of an inner core engine structure to at least partially define an annular core gas flow path. Stator 200 may comprise a plurality of vanes 230 disposed between outer shroud 210 and inner shroud 220.

Stator 200 may increase pressure in the compressor, as well as direct air flow parallel to axis 120. The air flow may exert a circumferential torque on vanes 230. Stator 200 may comprise anti-rotation lugs 240. Anti-rotation lugs 240 may be configured to counteract the circumferential torque in order to prevent stator 200 from rotating as further discussed below. In various embodiments, anti-rotation lugs 240 may extend axially in an aft direction from stator 200. In various embodiments, anti-rotation lugs 240 may extend from inner shroud 220. Anti-rotation lugs 240 may be configured to contact a stationary component, such as a diffuser case, in order to prevent stator 200 from rotating.

In various embodiments, outer shroud 210, inner shroud 220, vanes 230, and anti-rotation lugs 240 may comprise a single casting. In various embodiments, stator 200 may comprise an age-hardenable, nickel-based superalloy.

Figure 3:
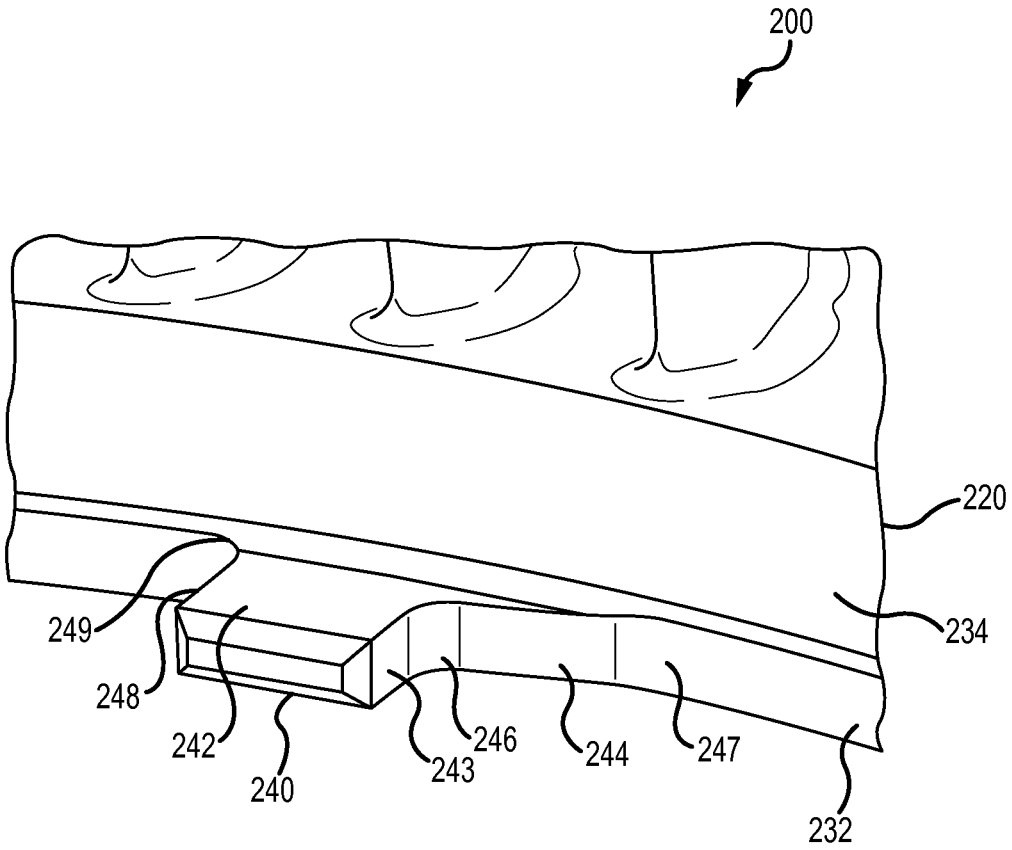
FIG. 3 illustrates a perspective view of an anti-rotation lug in accordance with various embodiments.
Figure 4:
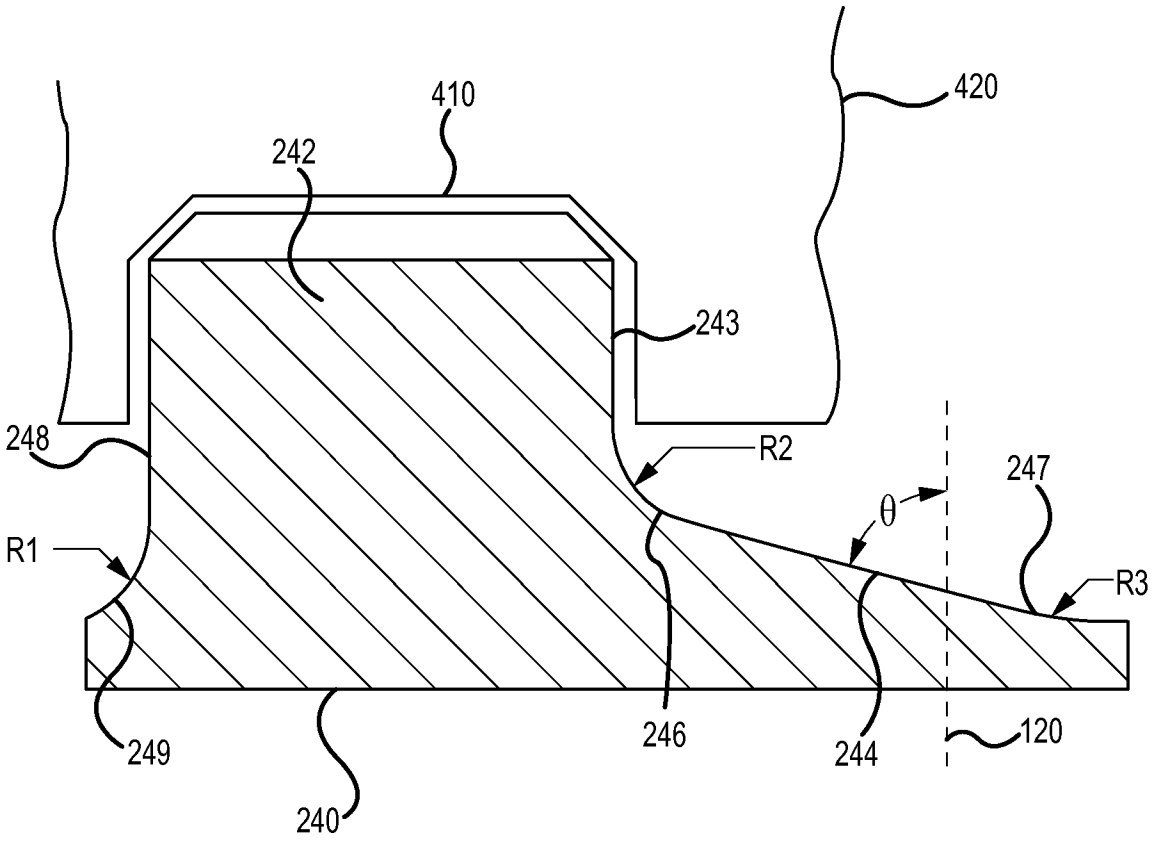
FIG. 4 illustrates a cross-section of an anti-rotation lug in accordance with various embodiments.

Referring to FIGS. 3 and 4, enlarged and cross-sectional views of anti-rotation lug 240 are illustrated in accordance with various embodiments of the present disclosure. Inner shroud 220 includes a stepped profile having an inner ring 232 and an outer ring 234. Inner ring 232 may extend axially from outer ring 234.

As discussed above, anti-rotation lug 240 may extend axially from inner ring 232. Anti-rotation lug may comprise a body 242 and a tapered shoulder 244. Body 242 may comprise a contact face 243. Tapered shoulder 244 may be located between contact face 243 and inner ring 232. Body 242 and tapered shoulder 244 may intersect in a leading fillet 246. Tapered shoulder 244 and inner ring 232 may intersect in a shoulder fillet 247. A trailing side 248 of body 242 and inner ring 232 may intersect in a trailing fillet 249.

In various embodiments, contact face 243 may be configured to contact a stationary component, such as a diffuser case. The contact between contact face 243 and the stationary component may prevent stator 200 from rotating. However, the contact may apply a significant load on anti-rotation lug 240. Tapered shoulder 244 distributes the stress concentration in anti-rotation lug 240. Thus, each anti-rotation lug 240 in a stator 200 is configured to accept higher loads without failing. It will be appreciated that if each lug 240 can accept higher loads, then the total number of anti-rotation lugs 240 on a given stator may be decreased, thus decreasing weight of the stator and its manufacturing costs. For example, stator 200 may comprise twenty-four anti-rotation lugs 240 with tapered shoulders 244, as opposed to a stator requiring thirty-six or more anti-rotation lugs without tapered shoulders.

It will be appreciated that the stepped profile described herein locally increases a load-carrying area of inner shroud 220, thereby reducing nominal or net-section stress in the region of inner ring 232, and decreasing the concentration of stress in the vicinity of anti-rotation lug 240. It will also be appreciated that such stress reduction will allow for a greater amount of force to be applied to a particular anti-rotation lug 240 without causing failure thereof, and allow fewer anti-rotation lugs 240 to be utilized on stator 200.

Referring to FIG. 4, the radii of leading fillet 246, shoulder fillet 247, trailing fillet 249, and the angle of tapered shoulder 244 may be iteratively calculated in order to distribute stress concentrations in anti-rotation lug 240. In various embodiments, trailing fillet 249 may comprise a radius R1 of about 0.125 inches (0.318 cm) or about 0.100 inches-0.150 inches (0.254 cm-0.762 cm). In various embodiments, leading fillet 246 may comprise a radius R2 of about 0.062 inches (0.157 cm) or about 0.05 inches-0.08 inches (0.127 cm-0.203 cm). In various embodiments, an angle θ between tapered shoulder 244 and axis of rotation 120 may be about 70°, or about 60°-80°. In various embodiments, a radius R3 of shoulder fillet 247 may be about 0.250 inches (0.635 cm), or between about 0.200 inches-0.300 inches (0.508 cm-0.762 cm).

It has been found that increasing the radii of leading fillet 246, shoulder fillet 247, and trailing fillet 249 generally better distributes stress concentrations in anti-rotation lug 240 caused by contact with a receiving slot 410 in a diffuser case 420. However, increasing the fillet radii in various embodiments also decreased the area of contact face 243. In various embodiments, the area of contact face 243 is maintained above minimum levels in order to meet bearing stress requirements. Bearing stress may be defined as the load on contact face 243 divided by the area of contact face 243. Thus, in various embodiments, the fillet radii may be maximized while maintaining bearing stress levels below maximum levels.

Benefits and advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A stator comprising:
an inner shroud; and
an anti-rotation lug coupled to the inner shroud, the anti-rotation lug extending in an axial direction from the inner shroud and comprising:
a body comprising a contact face; and
a tapered shoulder between the contact face and the inner shroud;
wherein the tapered shoulder and the inner shroud intersect in a shoulder fillet; and
wherein the contact face and the tapered shoulder intersect in a leading fillet.

2. The stator of claim 1, wherein the contact face is configured to contact a diffusor case to prevent the stator from rotating.

3. The stator of claim 1, wherein the shoulder fillet is located between the tapered shoulder and an inner ring of the stator.

4. The stator of claim 1, further comprising a trailing fillet located between a trailing side of the anti-rotation lug and an inner ring of the stator.

5. The stator of claim 1, wherein the tapered shoulder is oriented transverse to an engine axis at an angle of between 60-80 degrees.

6. The stator of claim 1, wherein the leading fillet comprises a radius of at least 0.050 inches, and wherein the shoulder fillet comprises a radius of at least 0.200 inches.

7. A stator comprising:
an outer shroud;
at least one vane coupled to the outer shroud;
an inner shroud coupled to the at least one vane, the inner shroud comprising an outer ring and an inner ring, the inner ring extending axially from the outer ring; and
an anti-rotation lug coupled to the inner shroud, the anti-rotation lug extending in an axial direction from the inner ring and comprising:
a body comprising a contact face; and
a tapered shoulder between the contact face and the inner ring;
wherein the tapered shoulder and the inner ring intersect in a shoulder fillet; and
wherein the contact face and the tapered shoulder intersect in a leading fillet.

8. The stator of claim 7, wherein the inner ring extends axially from the outer ring along an engine axis.

9. The stator of claim 7, wherein the leading fillet comprises a radius of about 0.062 inches.

10. The stator of claim 7, wherein the anti-rotation lug is configured to contact a diffuser case to prevent the stator from rotating.

11. The stator of claim 7, wherein the inner shroud comprises a stepped profile.

12. An assembly for a gas turbine engine, the assembly comprising:
a stator having an anti-rotation lug extending axially from an inner shroud of the stator, wherein the anti-rotation lug includes a tapered shoulder between a contact face of the anti-rotation lug and the inner shroud; and
a diffuser case in contact with the contact face of the anti-rotation lug.

13. The assembly of claim 12, wherein the anti-rotation lug is coupled to an inner ring of the stator.

14. The assembly of claim 12, wherein the inner shroud comprises a stepped profile.

15. The assembly of claim 12, wherein the stator comprises twenty-four anti-rotation lugs.

16. The assembly of claim 12, wherein the stator comprises a single component manufactured by at least one of casting, machining, additive manufacturing, and assembly of component parts.

* * * * *